US010467997B2

(12) United States Patent
Schmick et al.

(10) Patent No.: US 10,467,997 B2
(45) Date of Patent: Nov. 5, 2019

(54) COLLAPSIBLE MUSIC STATION

(71) Applicant: SCHMICK, LLC, Houston, TX (US)

(72) Inventors: Luke Schmick, Houston, TX (US); Alexandra Schmick, Houston, TX (US)

( * ) Notice: Subject to any disclaimer, the term of this patent is extended or adjusted under 35 U.S.C. 154(b) by 0 days.

(21) Appl. No.: 15/920,462

(22) Filed: Mar. 14, 2018

(65) Prior Publication Data

US 2019/0287501 A1 Sep. 19, 2019

(51) Int. Cl.
*G10G 5/00* (2006.01)
*G10D 13/08* (2006.01)

(52) U.S. Cl.
CPC ..... *G10G 5/005* (2013.01); *G10D 13/08* (2013.01)

(58) Field of Classification Search
CPC ..... G10G 5/005; G10G 5/00; G10D 13/08; G10D 13/02; G10D 13/00
See application file for complete search history.

(56) References Cited

U.S. PATENT DOCUMENTS 116,793 A * 7/1871 Atkins et al. ..... G10D 13/08 84/403
1,100,671 A * 6/1914 Deagan ..... G10D 13/08 84/403
1,576,443 A * 3/1926 McElhany ..... G10D 13/06 84/418
1,608,273 A 11/1926 Glasgow
1,688,450 A 10/1928 Corbett
1,752,529 A 4/1930 Kitching
1,843,034 A * 1/1932 Levgold ..... G10D 15/00 84/170
2,434,137 A * 1/1948 Zimmerman ..... G10D 13/08 84/403
2,584,554 A * 2/1952 Clayton ..... G10D 13/06 84/170
3,326,074 A * 6/1967 Osty ..... G10D 13/029 84/411 R
3,433,115 A * 3/1969 Kjelstrom ..... G10D 13/00 84/411 M
4,727,702 A * 3/1988 Baker ..... E06B 11/02 49/381

(Continued)

OTHER PUBLICATIONS

Notice of of References cited received in U.S. Appl. No. 15/640,527 dated Jan. 24, 2018.

(Continued)

*Primary Examiner* — Robert W Horn
(74) *Attorney, Agent, or Firm* — Darryl E. Scott

(57) ABSTRACT

A collapsible music apparatus comprising a plurality of interactive panels, wherein the interactive panels are formed using panel members and panel brackets. The collapsible music apparatus also includes one or more joiners placed between abutting interactive panels, wherein the joiners form joints between the abutting interactive panels. The apparatus also includes one or more music devices coupled to the panel members of the interactive panels; wherein the interactive panels are formed by connecting the panel members and the panel brackets. The apparatus also includes interactive panels that rotate and move freely with respect to one another at the joints between the abutting interactive panels; wherein the interactive panels are collapsed when the interactive panels are folded into each other at joints between the abutting interactive panels.

20 Claims, 13 Drawing Sheets

(56) References Cited

U.S. PATENT DOCUMENTS

D298,800 S * 12/1988 Diaz ..... 84/402
4,987,817 A * 1/1991 Diaz ..... G10D 13/06 84/421
5,076,131 A * 12/1991 Patterson ..... G10H 1/32 84/412
5,140,889 A * 8/1992 Segan ..... G10D 13/024 446/408
D346,081 S * 4/1994 Turner ..... D6/681.1
5,352,149 A 10/1994 Melashenko et al.
5,531,148 A * 7/1996 Wilson ..... G10D 13/024 84/412
5,632,584 A 5/1997 Acevedo
6,161,320 A * 12/2000 Peterson ..... G09F 15/0025 160/135
6,182,740 B1 * 2/2001 Pfaff ..... A47G 5/00 160/135
6,281,417 B1 8/2001 Ladao
6,471,078 B2 * 10/2002 Pyle ..... G10D 13/00 211/85.6
6,720,490 B1 * 4/2004 Bruce ..... A47B 19/002 84/327
7,070,056 B2 * 7/2006 Powders ..... A47B 81/00 211/13.1
7,131,615 B1 * 11/2006 Bruce ..... A47B 19/002 248/127
7,642,440 B2 * 1/2010 Bailey ..... G10D 13/00 84/411 R
8,093,478 B2 * 1/2012 Bailey ..... G10D 13/00 84/412
8,835,733 B2 * 9/2014 Boulet ..... G10D 13/02 84/411 R
9,131,789 B1 * 9/2015 Williams ..... A47F 7/02
9,723,904 B1 * 8/2017 Taylor ..... A45C 11/16
9,792,887 B2 * 10/2017 Pinelli ..... G10D 13/00
10,013,960 B1 * 7/2018 Wish ..... G10D 13/02
2006/0185206 A1 * 8/2006 Du Bose ..... G09F 7/18 40/610
2008/0053288 A1 3/2008 Brunkalla
2012/0137554 A1 * 6/2012 Puello ..... G09F 15/0075 40/607.1
2013/0084556 A1 * 4/2013 Giampavolo ..... G09B 25/00 434/365
2013/0165012 A1 6/2013 Klauber et al.
2015/0056600 A1 * 2/2015 Melashenko ..... G09B 19/00 434/428
2015/0187344 A1 * 7/2015 James ..... F21V 33/0056 84/411 R
2015/0216328 A1 * 8/2015 Bubear ..... A47F 5/01 403/404
2016/0140940 A1 * 5/2016 Sprengel ..... G10D 7/00 84/170
2018/0137844 A1 * 5/2018 Schmick ..... G10G 5/005
2018/0240444 A1 * 8/2018 Israel ..... G10H 3/143
2018/0247620 A1 * 8/2018 Chandontrikij ..... G10D 13/02
2019/0001231 A1 * 1/2019 Schmick ..... A63H 5/00

OTHER PUBLICATIONS

Non Final Office Action received in U.S. Appl. No. 15/640,527 dated Jan. 24, 2018.
Notice of of References cited received in U.S. Appl. No. 15/640,527 dated Sep. 6, 2018.
Non Final Office Action received in U.S. Appl. No. 15/640,527 dated Sep. 6, 2018.
Non Final Office Action received in U.S. Appl. No. 15/352,417 dated Jan. 24, 2018.
Final Office Action received in U.S. Appl. No. 15/352,417 dated Oct. 2, 2018.
Notice of of References cited received in U.S. Appl. No. 15/352,417 dated Jan. 24, 2018.
Advisory Action received in U.S. Appl. No. 15/352,417 dated Dec. 13, 2018.
Notice of of References cited received in U.S. Appl. No. 15/920,462 dated Jan. 31, 2019.
Office Action received in U.S. Appl. No. 15/920,462 dated Jan. 31, 2019.
Bell, David., "Collapsible Cajon" YouTube video published Apr. 23, 2013, cited in the Non-Final Office Action in U.S. Appl. No. 15/920,462 dated Jan. 31, 2019, and obtained from https://www.youtube.com/watch?v=HARj0TyUkmY.

* cited by examiner

COLLAPSIBLE MUSIC STATION

BACKGROUND OF THE DISCLOSURE

Musical toys are popular with young children and may come in different shapes and arrangements, which can stimulate the minds of children and allow them to learn about both musical devices and shapes. These toys are typically more interesting to children than toys that offer learning shapes, or toys that only produce sound.

Many musical toys discussed above are further limited to producing a single sound or set of sounds, having only to press a button to hear one or more sounds. However, this repetitive activation of playing sounds, without allowing children to use their creative ability to create music, rapidly loses its ability to maintain the long-term attention and curiosity in children. Thus, in effect, these toys eventually become boring or uninteresting.

Further, many musical toys today, that aren't reduced to a simple activation of playing sounds, are still overly simplified wherein children are not offered opportunities to learn the simplest of structural components used to configure the musical toys, and or the configuation involved in creating different shapes or designs of the toys. Learning about the configuration of certain toys can be very enlightening for school age children that are beyond simple toys having touch activated sounds patterns, and who are ready to explore the full potential of their creativity.

Moreover, many musical toys today cannot offer the ability to immerse children within a learning environment. That is, many toys that are either handheld devices, or smaller in size, do not offer children the ability to be immersed within a learning environment; however, even musical toys that are larger in size are typically bulky and are difficult to store or disassemble.

It is therefore desirable to have a musical apparatus that can be operated by multiple users such as children, to explore musical devices, sounds, shapes and apparatus configurations at the same time. It is also desirable to have a musical apparatus which has the ability to be configured into different shapes and designs, and that can be easily assembled or disassembled. It is also desirable to have a musical apparatus that allows users to learn about the different shapes, configurations, and musical devices, while also allowing its users to be immersed within a learning environment.

It is further desirable to have an apparatus that can be easily assembled and disassembled, and that can be easily folded or collapsed in a manner wherein it needs minimal storage space.

The subject matter of the present disclosure is directed to overcoming, or at least reducing the deficiencies of, one or more of the problems set forth above.

SUMMARY OF THE DISCLOSURE

A collapsible music apparatus comprising a plurality of interactive panels, wherein the interactive panels are formed using panel members and panel brackets is provided. The collapsible music apparatus includes one or more joiners placed between abutting interactive panels, wherein the joiners form joints between the abutting interactive panels. As disclosed, the collapsible music apparatus also includes one or more music devices coupled to the panel members of the interactive panels; wherein the interactive panels are formed by connecting the panel members and the panel brackets.

The collapsible music apparatus includes interactive panels that rotate and move freely with respect to one another at the joints between the abutting interactive panels; wherein the interactive panels are collapsed when the interactive panels are folded into each other at joints between the abutting interactive panels. The collapsible music apparatus also includes panel brackets openings, and wherein the interactive panels are formed by connecting the panel members and the panel brackets.

Different configurations of the collapsible music apparatus include a cube configuration, a rectangular prism configuration, a triangular prism configuration, a zig-zag configuration, and a display configuration. Also, the collapsible music apparatus includes one or more music devices coupled to the panel members, including one or more of cymbals, triangles, bells, chimes, and xylophones.

The foregoing summary is not intended to summarize each potential embodiment or every aspect of the present disclosure.

DETAILED DESCRIPTION OF THE DISCLOSURE

Overview of the System

Figure 1:
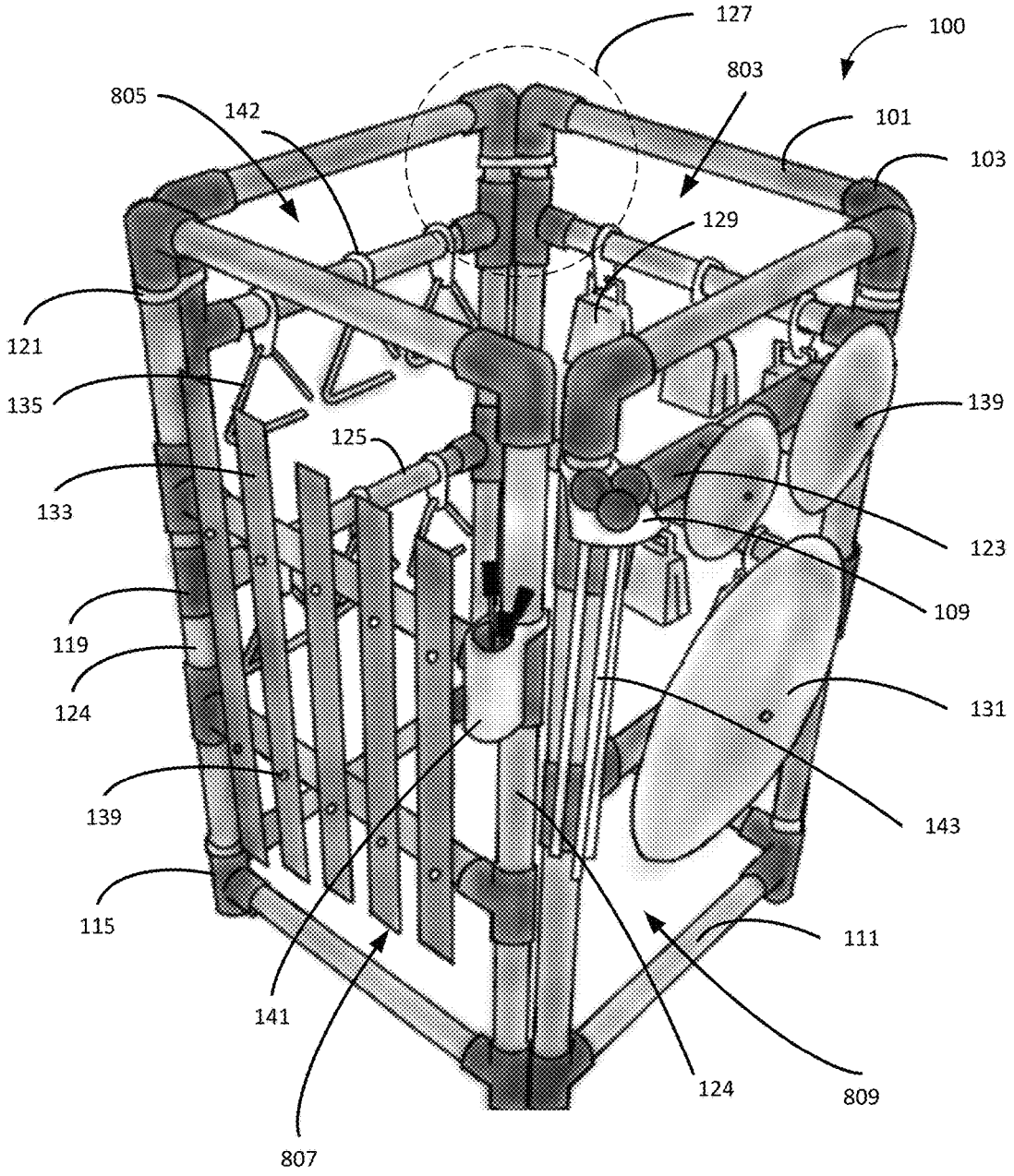
FIG. 1 illustrates a collapsible music station configured as a rectangular prism, according to the present disclosure.
Figure 8A:
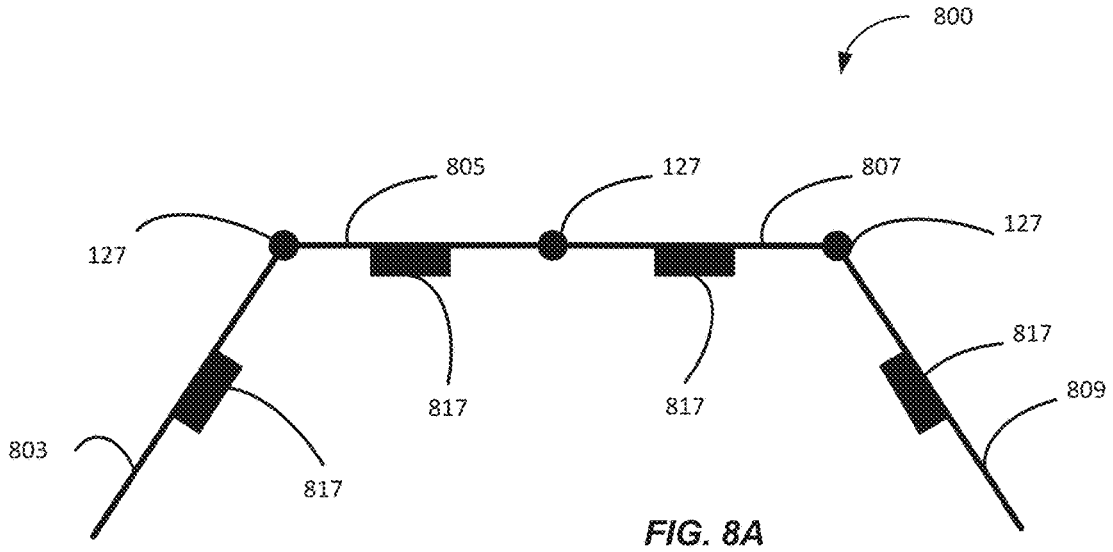
FIGS. 8A-8B illustrates example top view configuration diagrams of the collapsible music station, according to the present disclosure.
Figure 8B:
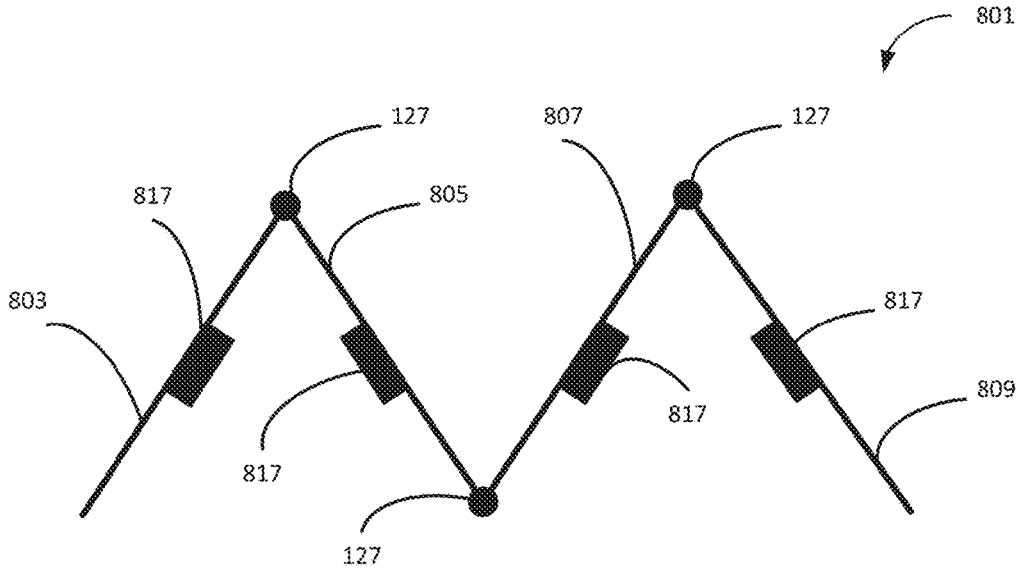
Figure 11:
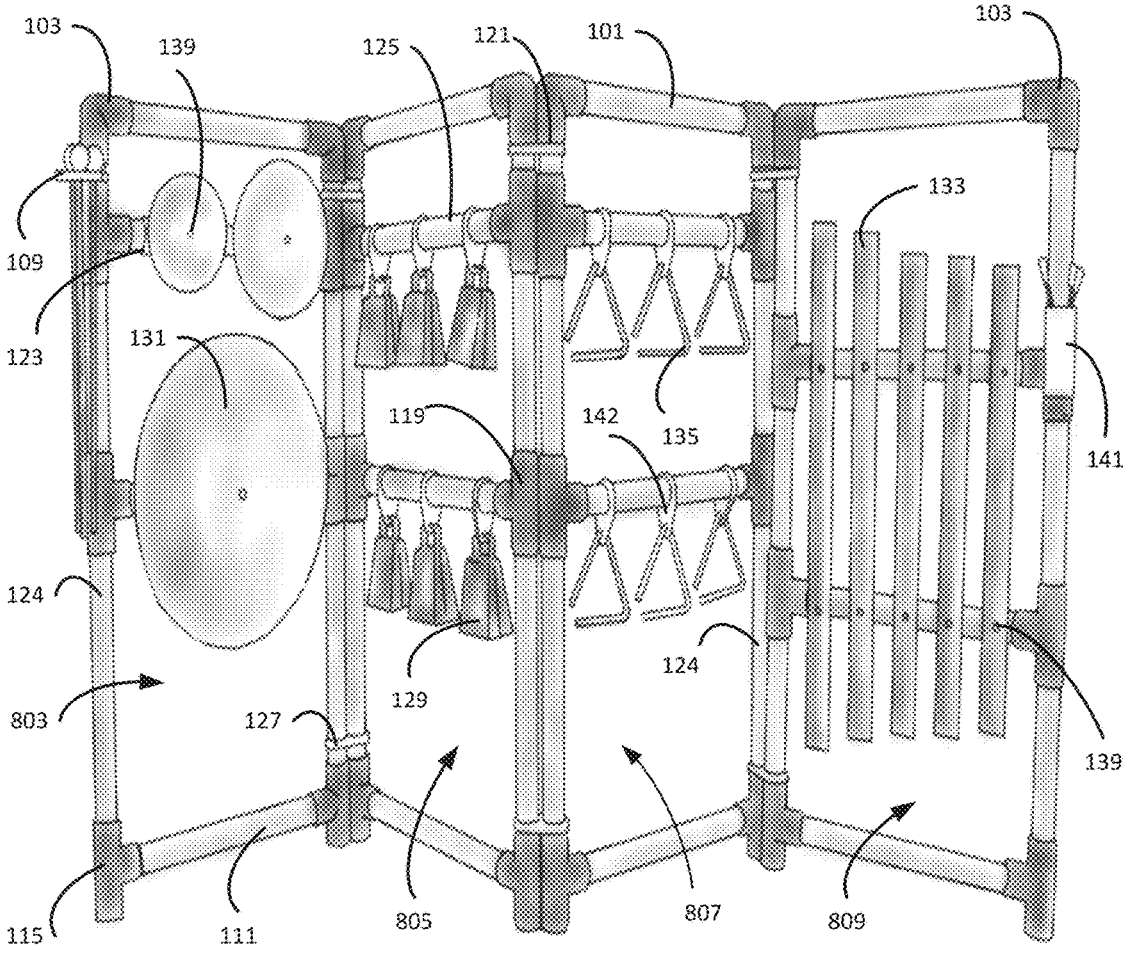
FIG. 11 illustrates an example collapsible music station having a zig-zag configuration, according to the present disclosure.

Referring to the illustration of FIG. 1, a collapsible music station 100 is shown configured as a rectangular prism. In one embodiment of the invention, depending on its configuration the collapsible music station 100 may include a plurality of interactive panels. For example, in one implementation of the invention, and as illustrated in FIGS. 8A, 8B, and FIG. 11, the collapsible music station 100 can have up to four interactive panels (803, 805, 807, and 809). Furthermore, each interactive panel can extend up to 18 inches in length and 34 inches in height. In another embodiment, the collapsible music station 100 may extend greater or less than 18 inches in length and 34 inches in height.

In yet another embodiment however, the collapsible music station 100 can include less than or more than four interactive panels e.g., 803, 805, 807, and 809. As discussed below, this allows for additional configurations of the collapsible music station 100. The collapsible music station 100 may further be configured in different shapes and or designs, including a cube configuration, triangular prism, rectangular prism, a zig-zag configuration, and a display configuration. In a cube configuration for example, the length and height of the interactive panels 803, 805, 807, and 809 are the same.

In one implementation, the interactive panels 803, 805, 807, and 809 include interactive panel members "panel members." Referring to the example of FIG. 1, panel members can include upper members 101, inner members 125, lower members 111, and side members 124. In another example, interactive panels 803, 805, 807, and 809 may also include interactive panel brackets "panel brackets." Panel brackets can include upper brackets 103, inner brackets 119, interactive brackets 123, and lower brackets 115.

In one implementation of the invention, the panel members and panel brackets discussed above may comprise a hard plastic material. In other embodiments however, one or more of the panel members and panel brackets may include plastic, wood, metal, or other like material. Also, the upper members 101, inner members 125, lower members 111, and side members 124 may include a tubular pipe form.

In one implementation, each of the upper brackets 103, inner brackets 119, interactive brackets 123, and lower brackets 115 may have a similar tubular shape and can include openings (e.g., upper bracket openings 201, inner bracket openings 301, lower bracket openings 305) at the outer edges that can be used to form interactive panels 803, 805, 807, and 809 by connecting panel members and panel brackets, as described below.

Figure 2A:
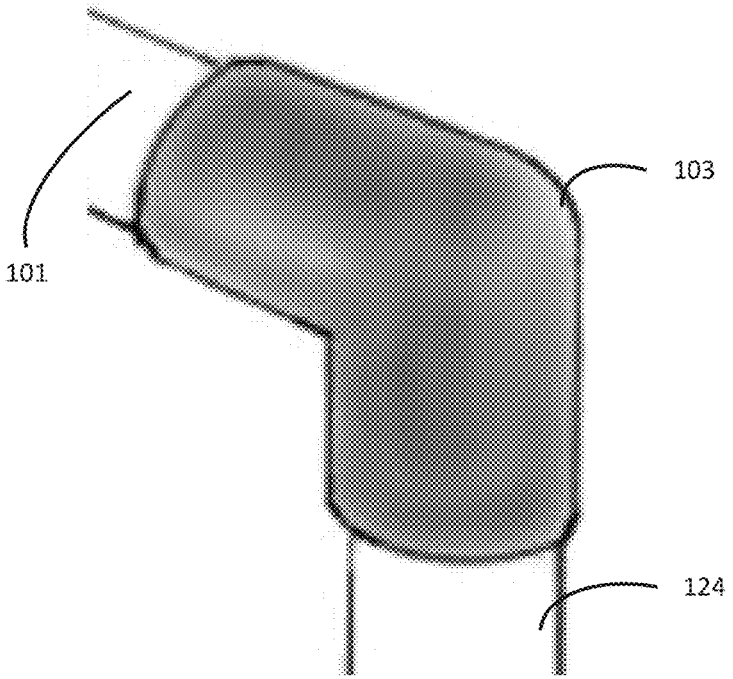
FIGS. 2A-2B illustrate example views of an upper bracket, according to the present disclosure.
Figure 2B:
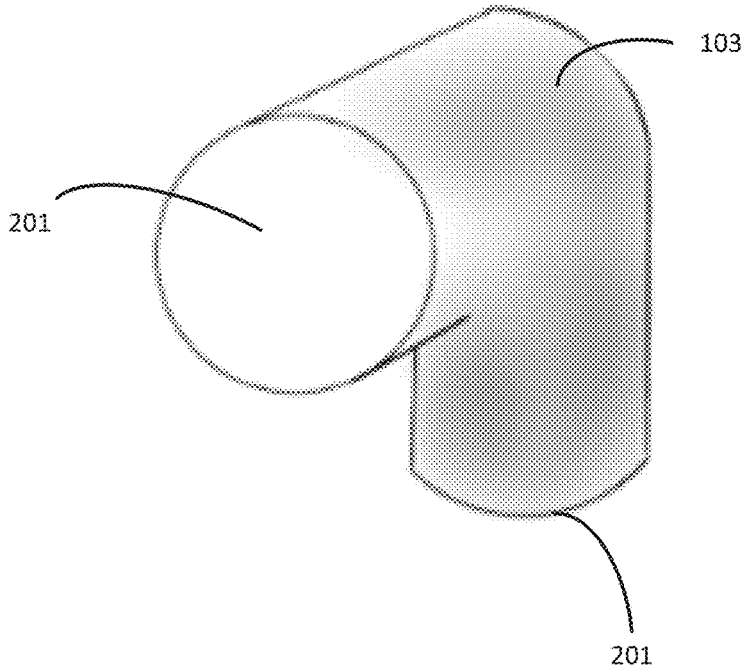

FIGS. 2A-2B illustrate example views of an upper bracket 103, according to the present disclosure. An upper bracket 103 may comprise a hard plastic material as discussed above, and as shown in FIGS. 2A-2B the upper bracket has an angled configuration. Also, as shown in FIG. 2B the upper bracket 103 has upper bracket openings 201 at its outer edges. As described above, in one implementation of the invention the bracket openings 201 can be used to connect the panel members and panel brackets, of the interactive panels 803, 805, 807, and 809. As shown in FIG. 2A, one example upper bracket 103 is connected to an upper member 101 at the outer edge of the upper bracket 101, toward the top of the upper bracket 103. In making this connection, the upper member 101 is inserted into the upper bracket opening 201 of the upper bracket 103.

In one implementation, in order to make this connection the diameter of the upper member must be less than the diameter of the upper bracket opening 201. This is so that the upper member 101 may be inserted into the upper bracket 103 thereby creating a connection. Referring again to the example of FIG. 2A, a connection between the upper bracket 103 and a side member 124 is formed by inserting the side member into the upper bracket opening 201 as shown.

In an embodiment, the formation of each interactive panel 803, 805, 807, and 809 includes having two upper brackets 103 connected by an upper member 101, toward the top of the upper brackets 103, and two side members 124 connected to the upper brackets 103 toward the bottom of the upper brackets 103. The formation further includes connecting with inner brackets 119 and lower brackets 115, as shown in FIGS. 3A-3B.

Figure 3A:
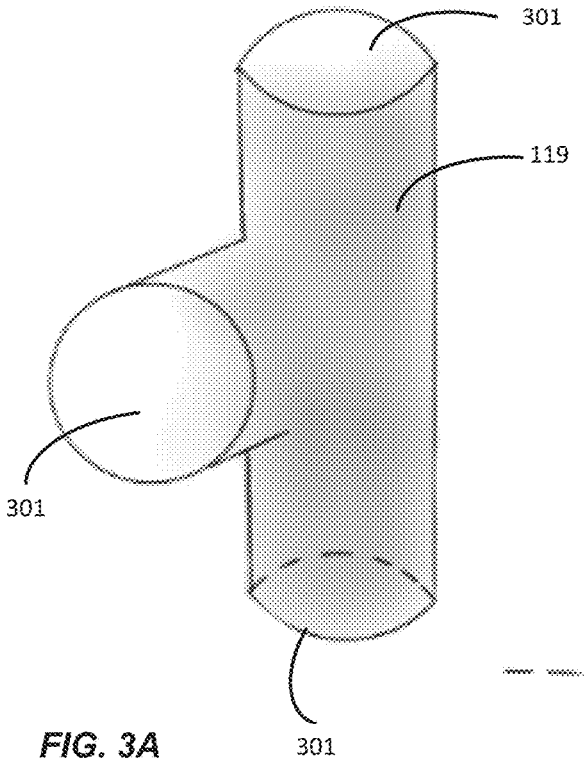
FIGS. 3A-3C illustrate example views of an inner bracket and lower bracket of the collapsible music station, according to the present disclosure.
Figure 3B:
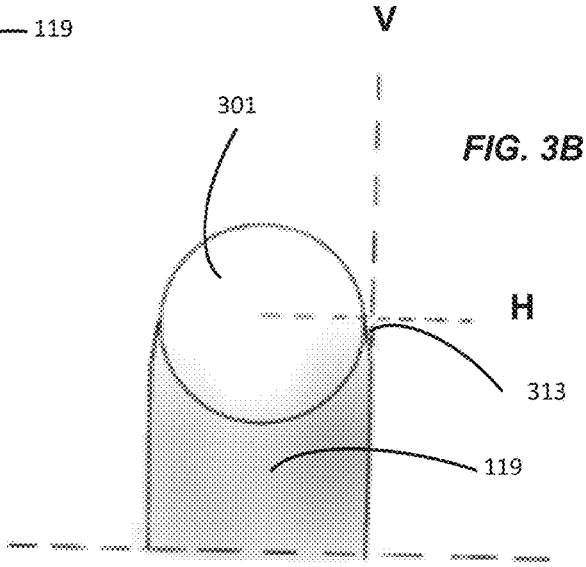
Figure 3C:
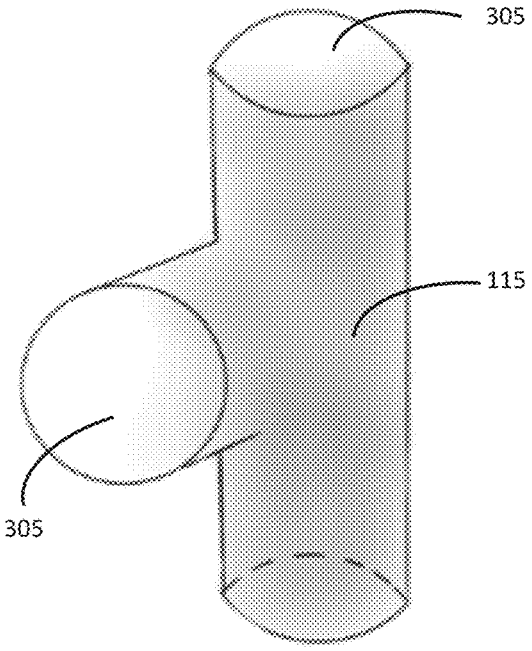

FIGS. 3A-3C illustrate example views of an inner bracket and lower bracket of the collapsible music station, according to the present disclosure. An inner bracket 119 is shown in FIG. 3A, having three inner bracket openings 301. As described above, the bracket openings 301 are at the outer edges of the panel brackets. Referring now to the illustration of FIG. 3C, a lower bracket is shown. Referring briefly to the illustration of FIG. 1, the placement of both the inner brackets 119 and lower brackets 115 is shown.

In one example, the formation of interactive panels 803, 805, 807, and 809 includes two lower brackets 115 connected to the opposite ends of side members 124, connected to the upper brackets 103 discussed above. As discussed above, the connections between the side members 124 and the lower brackets 115 are formed by inserting the side members into the lower bracket openings 305 toward the top of the lower brackets 115. Also, as shown in FIG. 3C, the lower brackets 115 have lower bracket openings 305 at each side for connecting with lower members 111. In this example, the opposite ends of lower members 111 are connected with the lower bracket openings 305 of opposing lower brackets 305, as shown in FIG. 1. In another example of the present invention, lower brackets 115 have a flat base at the bottom for stabilizing the collapsible music station 100. In one embodiment, the panel members 101, 124, 111, and 125, and the openings of brackets 103, 119, 115, and 123 can range from ½ inch to 3 inches in diameter. In other embodiments however, the panel members and panel brackets of the music station 100 may be greater than 3 inches or less than ½ inches in diameter.

Referring to the illustration of FIG. 3B, the inner bracket opening 301 at the topmost part of an inner bracket 119 is shown. In an implementation of the invention, the openings of the panel brackets include an offset, as indicated at 313 using the example inner bracket 119. As shown, using the inner bracket 119 as an example, the offset described above represents a difference between the diameter of the inner bracket opening 301 and the outer diameter of the inner bracket 119 at the vertical (V) and horizontal (H) intersection shown.

For example, at each offset 313, the outer diameter of the inner bracket 119 is angled toward a smaller diameter of inner bracket opening 301. This offset, may provide additional safety for the users of the collapsible music station 100, and in one example it can prevent users from being scratched or scraped by the edges of the panel brackets while the collapsible music station 100 is being used or configured.

Referring again to FIG. 3A, inner brackets 119 include three inner bracket openings 301. As shown, inner bracket 119 includes a topmost opening, a bottom most opening, and an opening towards the side of the inner bracket 119. In an implementation, the side members 124 are disposed through the top and bottom openings of the inner brackets 119, as shown in FIG. 1. Also, each of the inner brackets 119 oppose another inner bracket 119, and the opposite sides of an inner member 125 are connected to the side most inner bracket openings 301 of the opposing inner brackets 119.

Figure 4A:
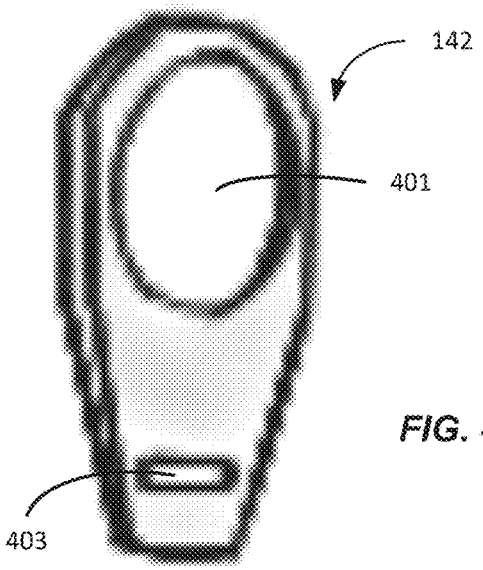
FIG. 4A illustrates a music device coupler according to the present disclosure.

As illustrated in FIG. 1, in an implementation, the interactive panels 803, 805, 807, and 809 may include one or more opposing inner brackets 119 and inner members 125. Also, as will be described later, one or more music devices 817 (e.g., music device keys 133, cymbals 131, or other devices) may be coupled to the inner members 125 of the interactive panels 803, 805, 807, and 809. Also, music device keys (keys) 133 can be xylophone keys, or other similar music devices 817 that can be used to produce sound when struck. Also as shown, music devices 817 may be coupled to inner members 125 using device couplers 142 as shown in FIG. 4A, as well as interactive brackets 123 as discussed below.

Referring again to the illustration of FIG. 1, in an embodiment of the invention, accessory devices such as 141 and 109 may be attached to one or more panel members of the interactive panels e.g., interactive panels 803, 805, 807, and 809. As shown in FIG. 1, accessory devices 141 and 109 are attached to the side members 124 of separate interactive panels 803, 805, 807, and 809; however, in another embodiment accessory devices 141 and 109 may be attached to other of the panel members. Moreover, in one implementation, accessory devices 141 and 109 may come in different designs and can serve as compartments for holding devices that are used to interact with musical devices 817 coupled to the interactive panels 803, 805, 807, and 809 as discussed below.

Figure 12:
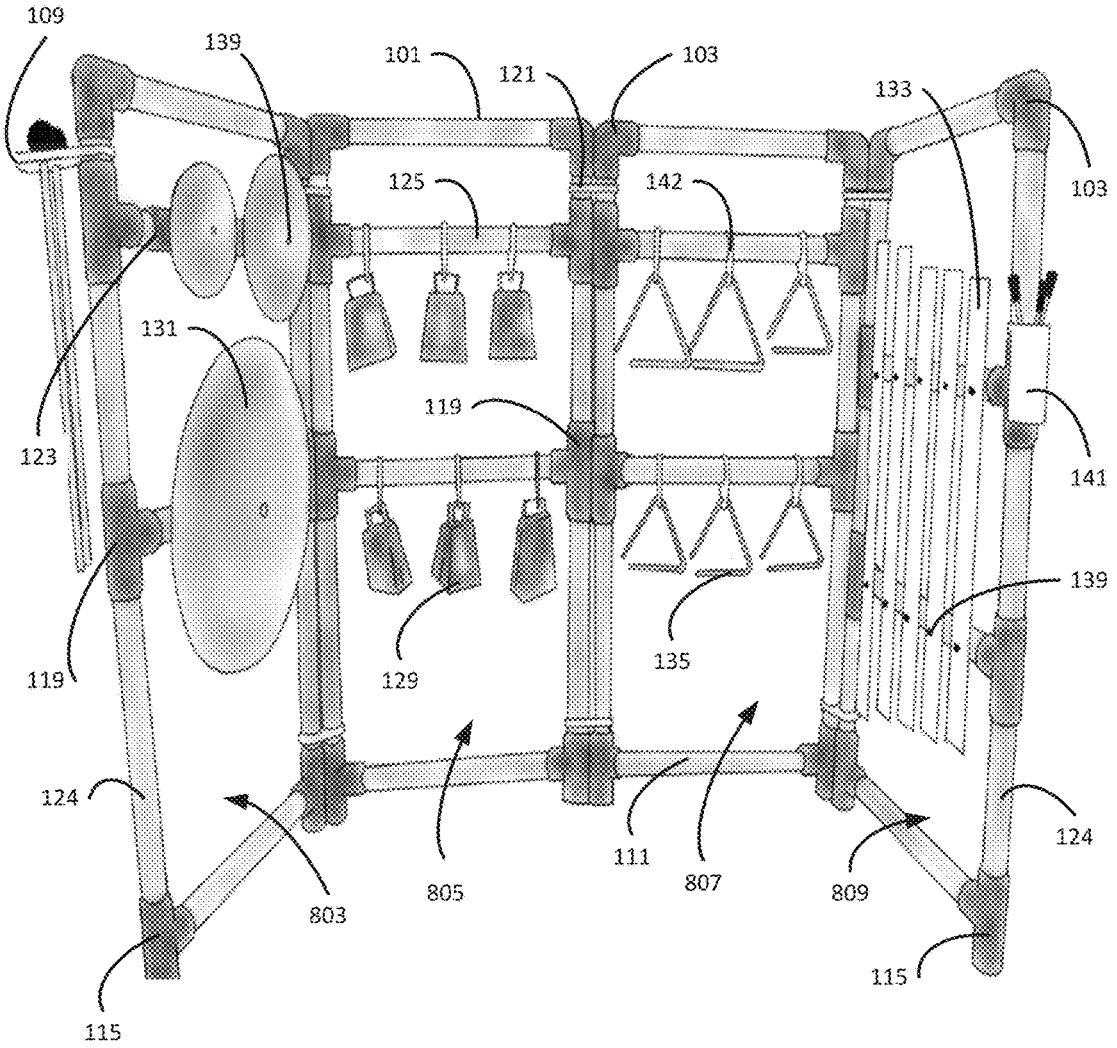
FIG. 12 illustrates an example collapsible music station having a display configuration, according to the present disclosure.
Figure 13:
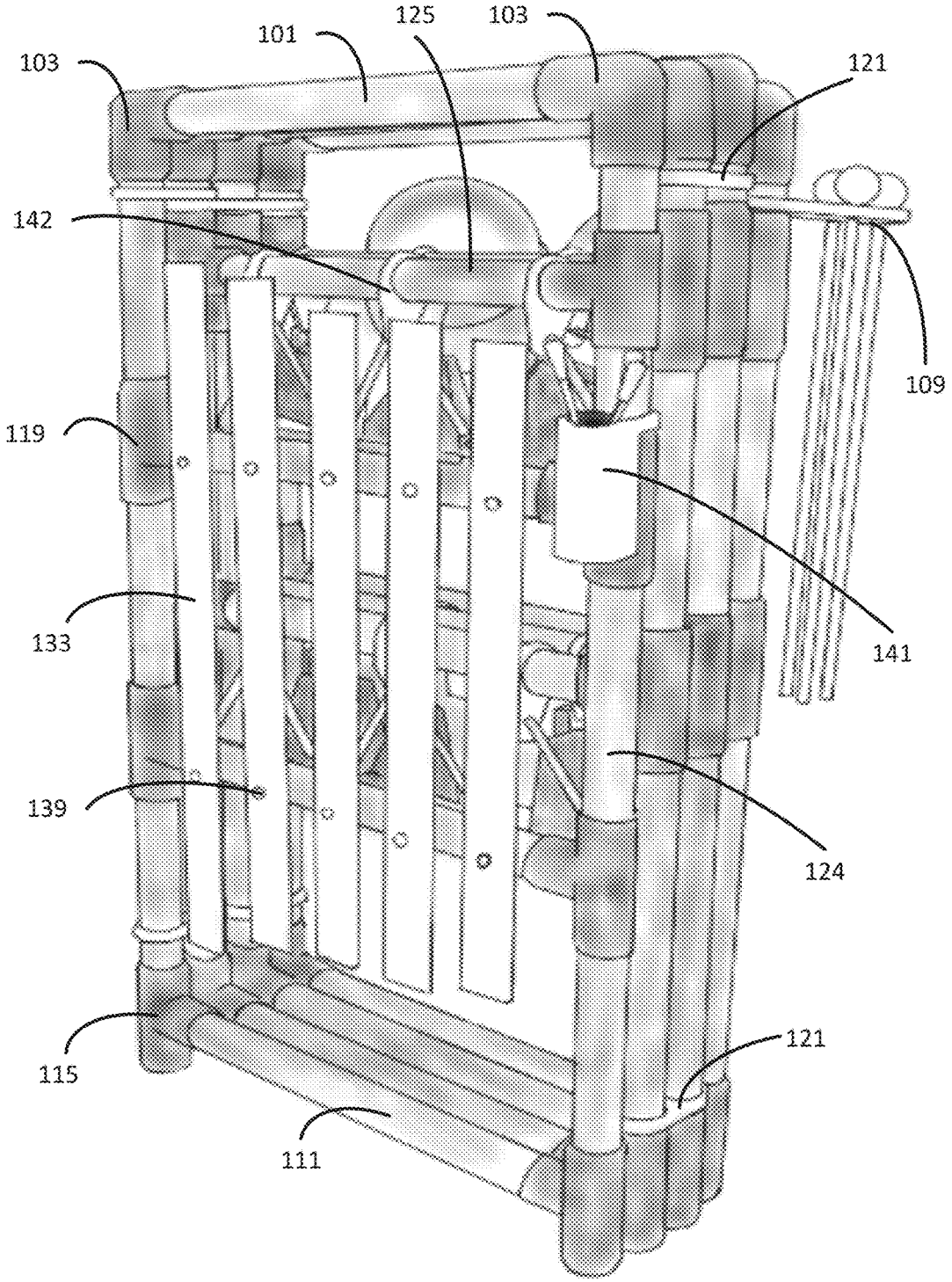
FIG. 13 illustrates an example collapsible music station having been collapsed, according to the present disclosure.

In one example, a device such as a mallet, hammer, or other device may be used to interact with music devices 817 such as cymbals 115, triangles 135, bells 129, or keys 133, and may be stored in accessory devices 141 and 109 as illustrated in FIG. 1, and as further illustrated in FIGS. 11, 12, and 13. In other implementations, accessory devices 141 may have the form of a cylindrical holder, wherein mallets, hammers, or other devices may be stored within; however, accessory devices 109 can be flattened and extend from panel members, having one or more openings within its flattened surface for device storage.

Furthermore, in one implementation accessory devices 141 and 109 may comprise a plastic material, however in other implementations of the invention they may be comprised of wood or other material. As discussed below with reference to FIG. 4B, accessory devices can include inner and outer arms similar to joiners 121, and also be similarly placed on panel members allowing the accessory devices 141 and 109 to rotate and move freely on panel members.

Figure 4B:
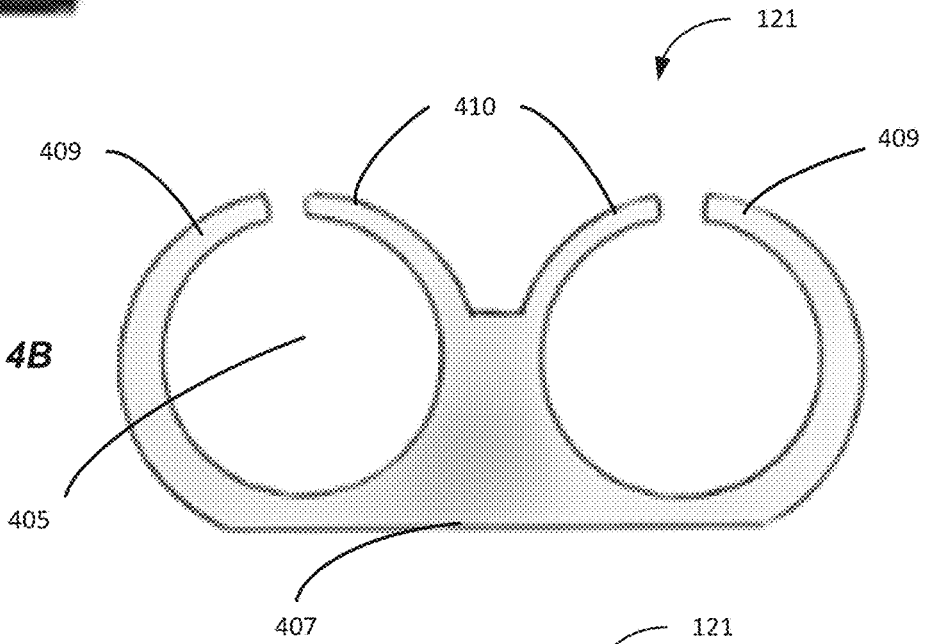
FIGS. 4B-4C illustrate example views of a joiner, according to the present disclosure.
Figure 4C:
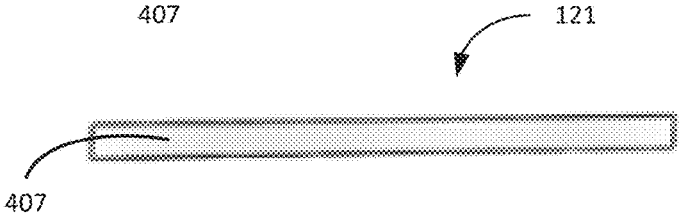

Referring now to a description of joiners 121, the interactive panels 803, 805, 807, and 809 may be joined together using one or more joiners 121, forming panel joints 127 along abutting edges of interactive panels 803, 805, 807, and 809. FIGS. 4B-4C illustrate example views of a joiner 121, according to the present disclosure. Referring now to FIG. 4B, a top view of a joiner 121 is shown. In one embodiment, joiners 121 may have inner arms 410 as well as outer arms 409 as well as a joiner base 407. Joiners 121 can be comprised of a hard plastic material; however, in other implementations joiners 121 may include plastic, wood, or other material.

In another example, the joiner base 407 may provide stability, while the inner arms 410 and the outer arms 409 are stable enough to hold panel members in place while also being retractably flexible so that the inner arms 410 and the outer arms 409 may be pulled away from each other in order to be placed around panel members. In one embodiment, once the inner arms 410 and the outer arms 409 are placed around panel members they retract toward each other so that they provide a force on the panel members thereby holding the panel members in place. However, in another embodiment, joinders 121 may be placed on each panel member during formation, wherein the joiners 121 will not need either inner arms 410 or outer arms 409.

In another example, the inner arms 410 and the outer arms 409, once placed on the panel members, hold the panel members in place with a force applied on the panel members that is not so strong that the panel members of the interactive panels 803, 805, 807, and 809 are unable to rotate and move freely with respect to one another, within the joiner openings 405. In one embodiment, this freedom of rotation and motion allowed between interactive panels (803, 805, 807, and 809) can enable quick configuration changes of the music station, e.g., from a cube configuration, triangular prism, rectangular prism, or to one or more of a zig-zag or display configuration. In another embodiment, the freedom of rotation and motion can also enable the collapsible music station 100 to be folded flat for easy storage and transport, as described below.

Figure 5:
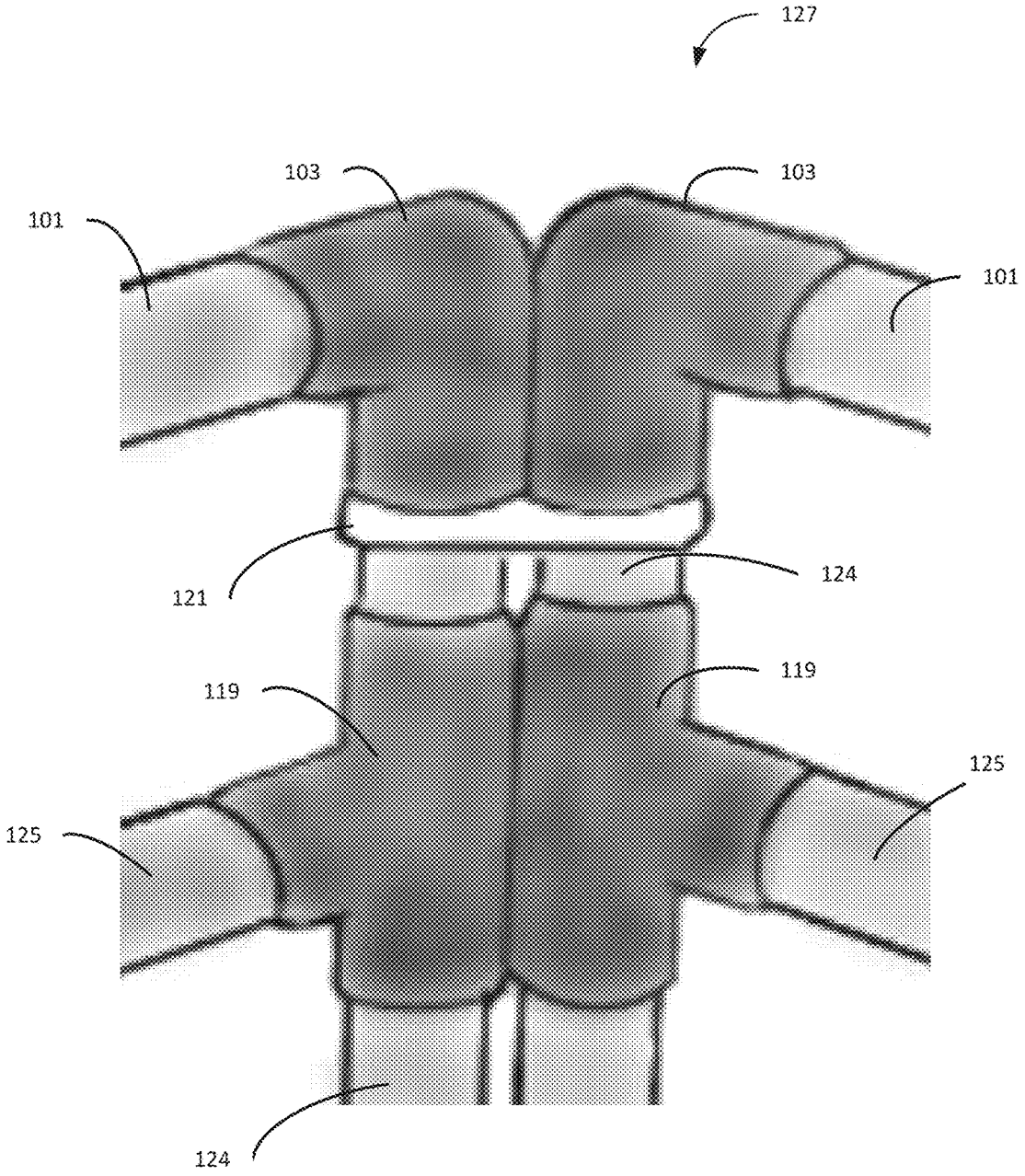
FIG. 5 illustrates an example view of an interactive panel joint, according to the present disclosure.

Referring to the example of FIG. 5, as shown a joiner 121 has been applied to the side members 124 of two abutting interactive panels 803, 805, 807, and 809. Also as shown in FIG. 5, in one embodiment joiners 121 may be placed under the upper brackets 103 of the two abutting interactive panels; however, in other embodiments joiners 121 may be placed at other locations along abutting interactive panels thereby joining abutting interactive panels and forming a panel joint 127. In one embodiment of the invention, one joiner 121 can be placed toward the top of the abutting side members 124 under the upper brackets 103, and one joiner 121 can be placed toward the bottom of the abutting side members 124 above the lower brackets 115 of interactive panels. However, in other embodiments two or more joiners 121 may be placed at any place along abutting side members of interactive panels to create panel joints 127, as long as the placement of the joiners 121 provides the interactive panels with stability suitable for use.

As discussed above, in an embodiment of the invention music devices 817 may be coupled to the inner members 125 as well as other panel members using device couplers 142 as well as interactive brackets 123. Such devices include, triangles 135, bells 129, and other such devices. Referring to the illustration of FIG. 4A, a device coupler 142 is shown. A device coupler in one implementation couples a music device, such as described above, with panel members. Using the example of FIG. 1, device couplers 142 are used to couple triangles 135, and bells 129 to the inner members 125 of the interactive panels of the collapsible music station 100.

Referring again to FIG. 4A, device couplers 142 can comprise of a thin plastic material, and can have device coupler openings 401 as well as a device coupler slits 403. In one embodiment, panel members may be inserted through device coupler openings 401 in order to attach device couplers 142 to the panel members, for example inner member 125. In another embodiment however, a separation can exist in the device coupler 142 near the device coupler opening 401, in order to allow the device coupler 142 to be placed on the panel member. Referring now to the bottom most part of the device coupler 142 in FIG. 4A, the device coupler slit 403 is shown.

Device coupler slits 403 are openings toward the bottom of the device coupler 142, wherein music devices 817 can be placed. In one embodiment, either before or after device couplers 142 are attached to the panel members, one or more music devices 817 e.g., triangles 135 and bells 129 can be placed within the device coupler slits 403. In one example, the device coupler slits 403 include a separation on either side of the device coupler 142 toward the edge of the device coupler slit 403. Music devices 817 as discussed above may be placed inside the device coupler slits 403 through the separations. In one implementation, music devices 817 are coupled to the panel members once the device couplers 142 are attached to the panel members, and the music devices 817 are attached to the device couplers 142.

Figure 6:
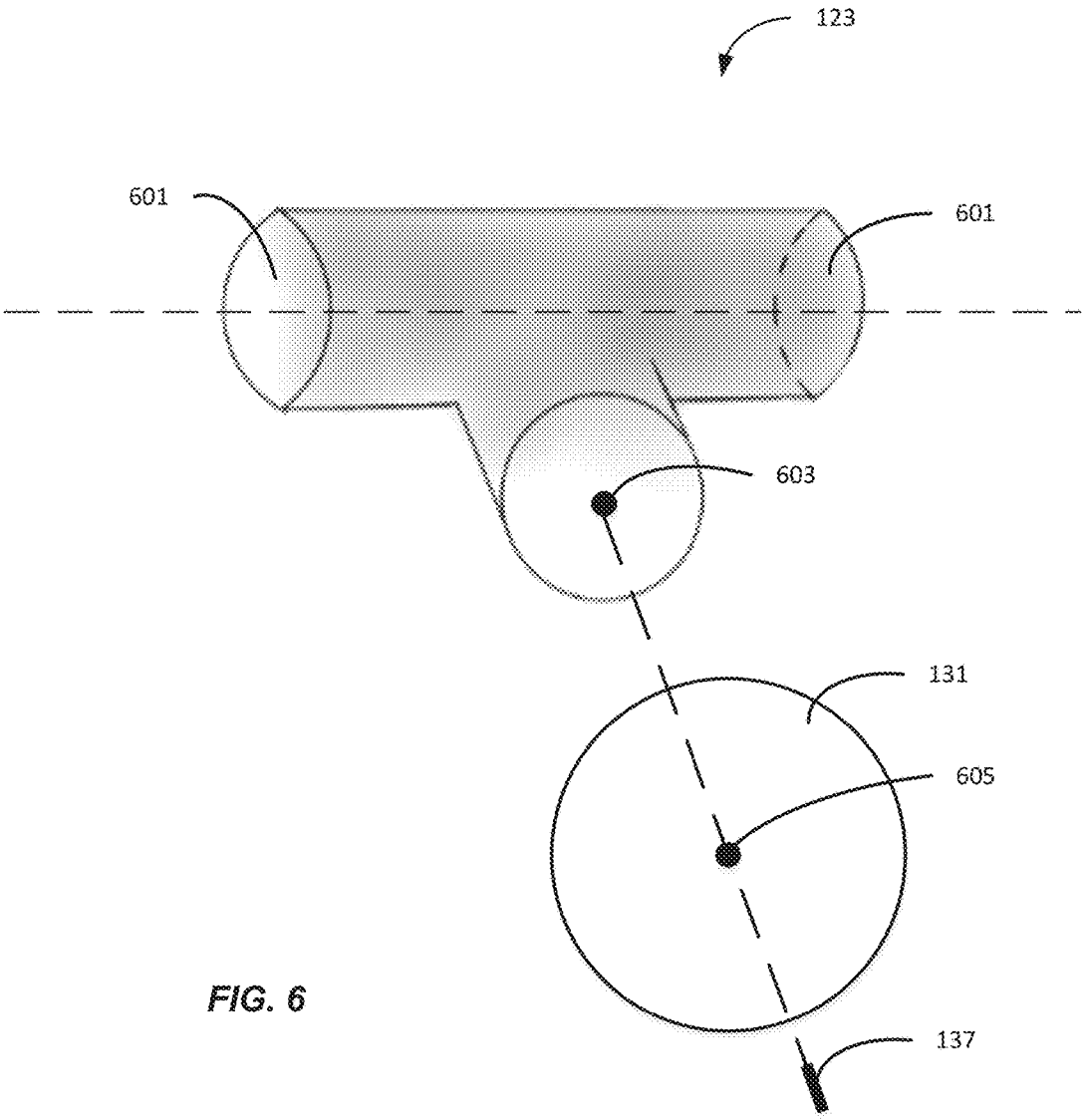
FIG. 6 illustrates an example interactive bracket of the collapsible music station, according to the present disclosure.

In another embodiment, music devices 817 may be coupled to inner members 125 and other panel members using interactive brackets 123. FIG. 6, illustrates and example of an interactive bracket 123, according to the present disclosure. As shown in FIG. 6, the interactive bracket 123 can include interactive bracket openings 601 at the end of each side of the interactive bracket 123. As shown in the illustration of FIG. 1, in an implementation, panel members e.g., inner members 125 may be inserted through interactive bracket openings 601 thereby attaching the interactive brackets 123 to the inner members 125. As shown in FIG. 6, in one embodiment interactive brackets 123 can include an extension, which has a coupling hole 603 at its center that may be used to couple music devices 817 such as cymbals 131 or other music devices 817 to the interactive brackets 123.

As shown in FIG. 6, a cymbal 131 having a cymbal opening 605 at its center may be coupled to the interactive bracket 123 using one or more pins 137. In one embodiment, a pin may be a screw, bolt, nail, or other similar device that can be inserted through an opening and a music device such as the cymbal opening 605, and into the coupling hole 603 of the interactive bracket 123, thereby removably coupling the cymbal 131 to the interactive bracket 123.

Figure 7:
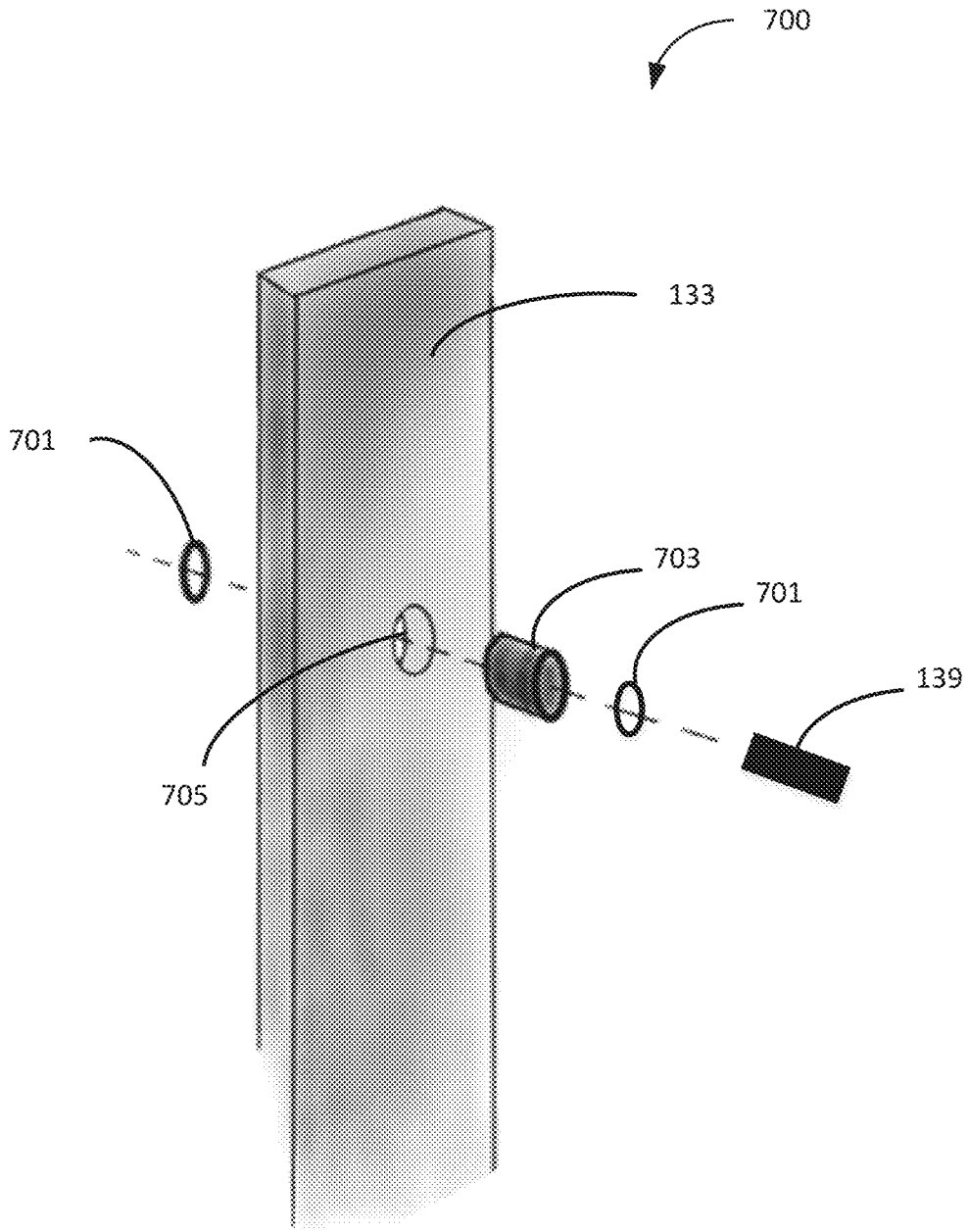
FIG. 7 illustrates a mounting screw assembly inserted into a music device key, according to the present disclosure.

FIG. 7 illustrates a mounting screw assembly 700 inserted into a music device key 133, according to the present disclosure. In one implementation of the invention, one or more music devices 817 and music device keys 133, such as the keys 133 of a xylophone can be coupled to panel members, such as inner members 125, of the interactive panels 803, 805, 807, and 809 using pins 137. However, in another embodiment music device keys 133 may be coupled to one or more panel members using mounting screw assemblies 700. Using the example of FIG. 1, xylophone keys 133 may include aluminum, or other metallic, hand polished keys 133 and may have a, but not limited to, a thickness of % inches.

The mounting screw assembly 700 as shown in FIG. 7, can include a mounting screw 139 disposed within washers 701 and can include a housing 703, as shown. Also, although a xylophone key 133 with a key hole 705 is illustrated in FIG. 7 as the music device 817 to be coupled to the one or more panel members, such as inner members 125 as illustrated in FIG. 1, in other embodiments the mounting screw assembly 700 may be used for coupling other musical devices 817 to panel members, such as chimes (not shown), or other music devices 817 known in the art. Further, in one implementation of the invention, the mounting screws 139 of the mounting screw assembly 700 may include screws, bolts, nails or other like apparatuses.

Referring again to FIG. 7, the housing 703 may comprise of a plastic material, while the washers 701 may comprise of plastic or rubber. The combination of the housing 703 and the washers 701 in the mounting screw assembly 700 can reduce or prevent metal on metal contact, which may create unwanted noise during interaction with keys 133 or other music devices 817. Referring to FIG. 7, to couple a music key 133 to a panel member, the mounting screw 139 is inserted into the washers 701 and housing 703, wherein the housing is disposed within the music key hole 705. As disclosed, the mounting screw 139 is inserted through the key hole opening 705, wherein the mounting screw 139 can be disposed into panel members, as shown in FIG. 1.

As discussed above, the collapsible music station 100 may be configured into different shapes and or designs, including a cube configuration, triangular prism, rectangular prism, a zig-zag configuration, and a display configuration. FIGS. 8A-8B illustrates example top view configuration diagrams of the collapsible music station 100, according to the present disclosure.

Referring now to the top down diagram of FIG. 8A, a diagram of a collapsible music station 100 in a display configuration is shown. A frontal view of the display configuration of the music station 100 is further illustrated in FIG. 12. In FIG. 8A, the display configuration of the collapsible music station 100 is shown having three panel joints 127. As illustrated the panel joints 127 join interactive panel 803 to interactive panel 805. Also, as shown a panel joint 127 joins interactive panel 805 to interactive panel 807, while another panel joint 127 joins interactive panel 807 to interactive panel 809. As discussed above, each interactive panel e.g., 803, 805, 807, and 809 can rotate freely with respect to one another at each joint 127. As further illustrated in FIG. 12, and as discussed above, one or more music devices 817 may be coupled to interactive panels 803, 805, 807, and 809.

Referring now to the top down diagram of FIG. 8B, a diagram of a collapsible music station 100 in a zig-zag configuration is shown. Again, a frontal view of the zig-zag configuration of the music station 100 is further illustrated in FIG. 11. In FIG. 8B, the zig-zag configuration of the collapsible music station 100 is shown having three panel joints 127. As illustrated the panel joints 127 join interactive panels 803 to interactive panel 805. Also, as shown a panel joint 127 joins interactive panel 805 to interactive panel 807, while another panel joint 127 joins interactive panel 807 to interactive panel 809. As further illustrated in FIG. 11 and as discussed above, one or more music devices 817 may be coupled to interactive panels 803, 805, 807, and 809.

Figure 9A:
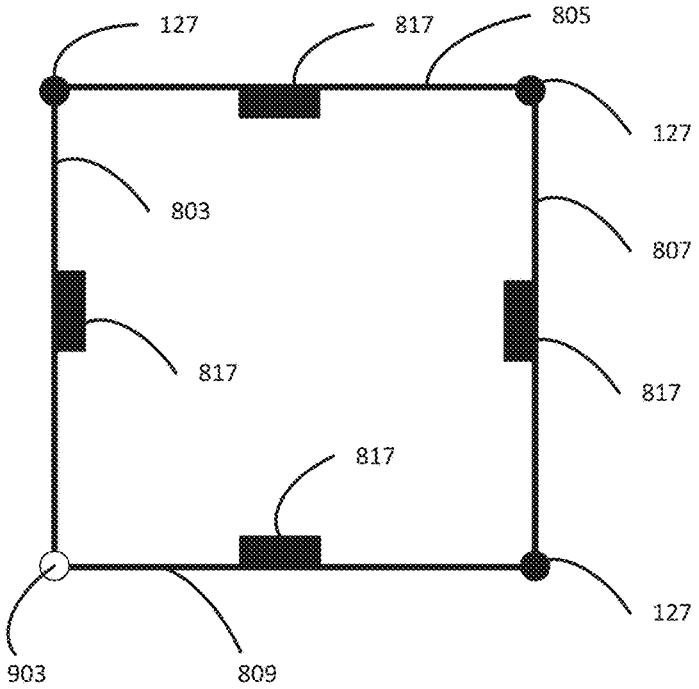
FIGS. 9A-9B illustrate example top view configuration diagrams of the collapsible music station, according to the present disclosure.
Figure 9B:
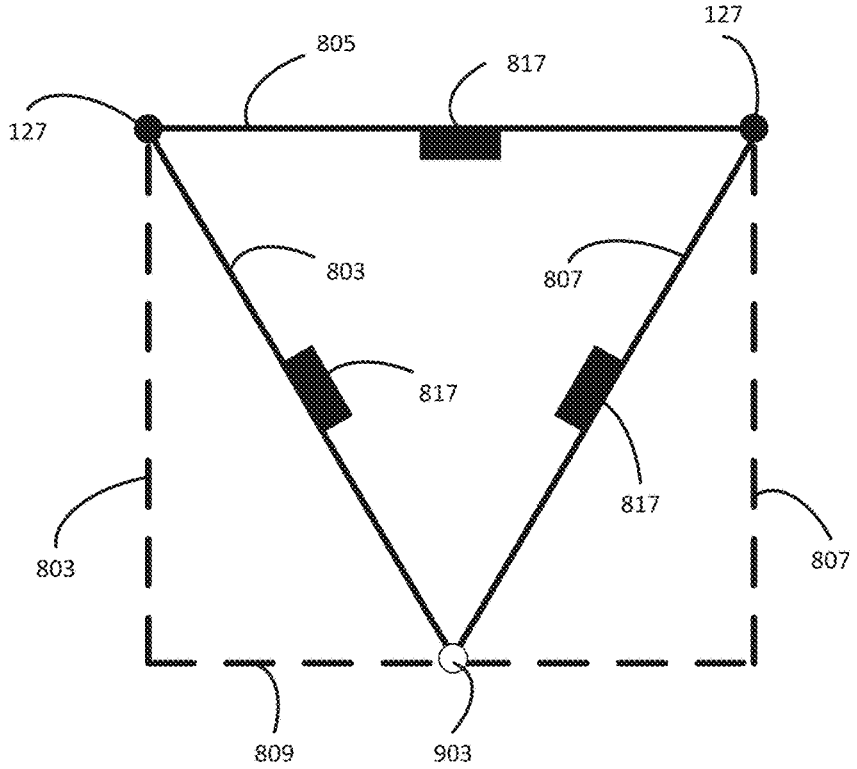

FIGS. 9A-9B further illustrate example top view configuration diagrams of the collapsible music station 100, according to the present disclosure. Referring to the illustration of FIG. 9A, a top view of a rectangular prism configuration of the collapsible music station 100 is shown. However, in another implementation, depending on the length and height of the interactive panels 803, 805, 807, and 809 as described above, the top view illustrated in FIG. 9A can also represent a cube configuration.

As illustrated in the top view of FIG. 9A panel joints 127 join the interactive panels 803, 805, 807, and 809, wherein the interactive panels have been configured in the form of a square. As shown, in one embodiment the interactive panels 803, 805, 807, and 809 can be joined at joints 127, and one or more music devices 817 may be coupled to the interactive panels 803, 805, 807, and 809. In another embodiment however, although the configuration shown in FIG. 9A has the form of a square, the configuration may only include three joints 127. In this implementation, and as shown between interactive panels 803 and 809 no joint 127 is used to join the interactive panels. Instead, between the interactive panels 803 and 809 a disjointed point 903 can exist, as shown. A disjointed point, can be a location where no joint 127 is formed between interactive panels 803, 805, 807, and 809.

Referring now to the top view illustration of FIG. 9B, a triangular prism configuration is shown. As described above the collapsible music station 100 can include less than four interactive panels 803, 805, 807, and 809. In one example, in FIG. 9B, only three interactive panels 803, 805, and 807 are used for the triangular prism configuration. In comparison to the top view configuration shown in FIG. 9A, the interactive panel 809 is not used. Instead, by removing interactive panel 809, and by moving interactive panels 803 and 807 toward each other, a triangular prism configuration may be formed. In one implementation, the triangular prism configuration has only two joints 127, and music devices 817 may be coupled to each of the interactive panels 803, 805 and 807, as shown. Also, as described above referring to the top view illustration of FIG. 9A, a disjointed point 903 can exist between interactive panels 803 and 809 of FIG. 9B, as shown.

The discussion will now turn to the collapsible music station's 100 ability to collapse. Many interactive music apparatuses are stationary, therefore once they are installed or put together, they remain unchanged and cannot be easily stored. However, as described herein, not only does the collapsible music station 100 allow for multiple configurations, it may further be collapsed or folded in an accordion like style, so that it is completely flat for easy storage.

Figure 10A:
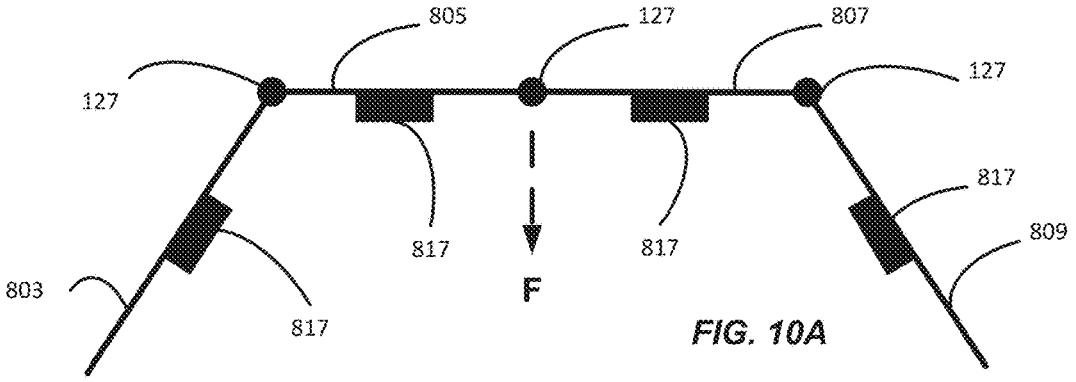
FIGS. 10A-10C illustrate an example top view diagram of the collapsible music station being collapsed, according to the present disclosure.
Figure 10B:
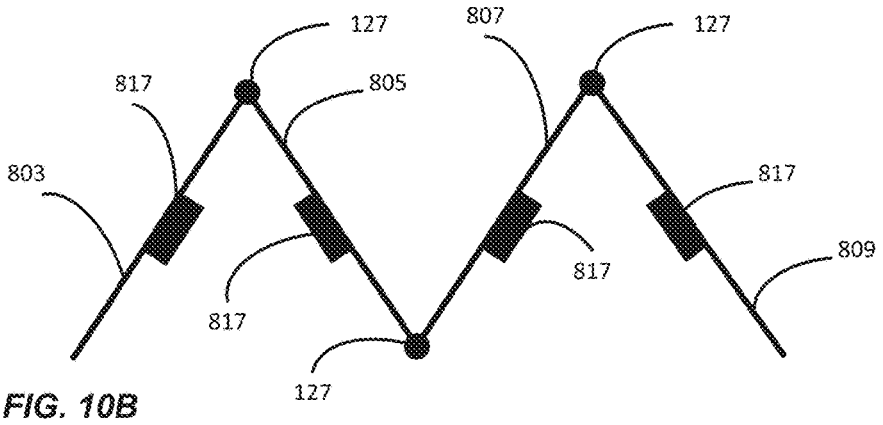
Figure 10C:
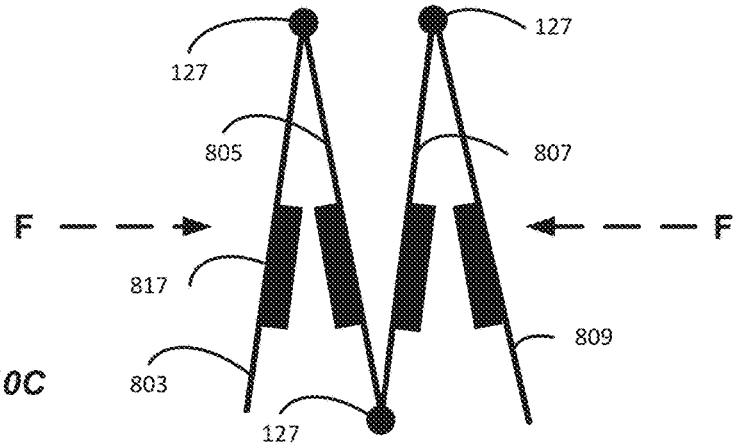

FIGS. 10A-10C illustrate an example top view diagram of the collapsible music station being collapsed, according to the present disclosure. As illustrated the panel joints 127 join interactive panels 803, 805, 807, and 809. As discussed above, each interactive panel e.g., 803, 805, 807, and 809 can rotate freely with respect to one another at each joint 127. In one embodiment, referring to FIG. 10A, a display configuration diagram of a collapsible music station 100 may be collapsed by folding each of the interactive panels 803, 805, 807, and 809 so that the collapsible music station 100 is in a zig-zag configuration, as shown in FIG. 10B. In this example, a force (F) may be applied at the joint 127 which connects interactive panel 805 and 807, as shown in FIG. 10A.

In one embodiment, once the collapsible music station 100 is configured in the zig-zag configuration, and as shown in FIG. 10C, a force (F) may be applied to the outer interactive panels 803 and 809, so that the interactive panels 803, 805, 807, and 809 are compressed inward toward each other, thereby collapsing the collapsible music station 100. In an example frontal view of the collapsible music station 100, having been collapsed is illustrated in FIG. 13. However, collapsible music station 100 may be collapsed using other methods, such as applying a force that folds the interactive panels 803, 805, 807, and 809 into each other, until the collapsible music station 100 is collapsed, as shown in FIG. 13.

In one implementation of the invention, the interactive panels 803, 805, 807, and 809 may be collapsed at each joint 127 in order to decrease or minimize the amount of space that the music station 100 consumes. This ability to minimize space can be useful when the collapsible music station 100 is not in use. When collapsed as described above, the collapsible music station 100 may be easier to transport or store.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, Applicants desire all patent rights afforded by the appended claims. Therefore, it is intended that the appended claims include all modifications and alterations to the full extent that they come within the scope of the present disclosure.

What is claimed is:

1. A collapsible music apparatus comprising:

a plurality of interactive panels, the interactive panels having panel members and panel brackets;

wherein the interactive panels are formed by connecting the panel members and panel brackets;

one or more joiners placed between abutting interactive panels, wherein the joiners form joints between the abutting interactive panels;

one or more music devices coupled to the panel members of the interactive panels;

wherein the interactive panels rotate and move freely with respect to one another at the joints between the abutting interactive panels; and wherein the interactive panels are collapsed when the interactive panels are folded into each other at the joints between the abutting interactive panels.

2. The collapsible music apparatus of claim 1, wherein the panel members include upper members, inner members, lower members, and side members.

3. The collapsible music apparatus of claim 2, wherein the upper members, inner members, lower members, and side members have a tubular form.

4. The collapsible music apparatus of claim 1, wherein the panel brackets include upper brackets, inner brackets, interactive brackets, and lower brackets.

5. The collapsible music apparatus of claim 1, wherein the panel brackets include openings.

6. The collapsible music apparatus of claim 5, wherein the openings include an offset.

7. The collapsible music apparatus of claim 1, wherein different configurations are formed by rotating the interactive panels at joints between the abutting interactive panels.

8. The collapsible music apparatus of claim 7, wherein the different configurations include a cube configuration, a rectangular prism configuration, a triangular prism configuration, a zig-zag configuration, and a display configuration.

9. The collapsible music apparatus of claim 1, wherein the one or more music devices coupled to the panel members include cymbals, triangles, bells, chimes, and xylophones.

10. A collapsible music apparatus comprising:

a plurality of interactive panels, the interactive panels include panel members and panel brackets;

wherein the interactive panels are formed by connecting the panel members and panel brackets;

wherein the panel members include upper members, inner members, lower members, and side members;

wherein the panel brackets include upper brackets, inner brackets, interactive brackets, and lower brackets;

one or more joiners placed between abutting interactive panels, wherein the joiners form joints between the abutting interactive panels;

one or more music devices coupled to the panel members of the interactive panels;

wherein the interactive panels rotate and move freely with respect to one another at the joints between the abutting interactive panels; and wherein the interactive panels are collapsed when the interactive panels are folded into each other at the joints between the abutting interactive panels.

11. The collapsible music apparatus of claim 10, wherein the panel brackets include openings.

12. The collapsible music apparatus of claim 11, wherein the openings include an offset.

13. The collapsible music apparatus of claim 10, wherein different configurations are formed by rotating the interactive panels at joints between the abutting interactive panels.

14. The collapsible music apparatus of claim 13, wherein the different configurations include a cube configuration, a rectangular prism configuration, a triangular prism configuration, a zig-zag configuration, and a display configuration.

15. The collapsible music apparatus of claim 10, wherein the one or more music devices coupled to the panel members include cymbals, triangles, bells, chimes, and xylophones.

16. A collapsible music apparatus comprising:

a plurality of interactive panels, the interactive panels having panel members and panel brackets;

wherein the interactive panels are formed by connecting the panel members and panel brackets;

wherein the panel members include upper members, inner members, lower members, and side members:

wherein the panel brackets include upper brackets, inner brackets, interactive brackets, and lower brackets;

one or more joiners placed between abutting interactive panels, wherein the joiners form joints between the abutting interactive panels;

one or more music devices coupled to the panel members of the interactive panels;

wherein the panel brackets include openings having an offset, the openings used when connecting panel members and panel brackets;

wherein the interactive panels rotate and move freely with respect to one another at the joints between the abutting interactive panels; and wherein the interactive panels are collapsed when the interactive panels are folded into each other at the joints between the abutting interactive panels.

17. The collapsible music apparatus of claim 16, wherein the upper members, inner members, lower members, and side members have a tubular form.

18. The collapsible music apparatus of claim 16, wherein the one or more music devices coupled to the panel members include cymbals, triangles, bells, chimes, and xylophones.

19. The collapsible music apparatus of claim 16, wherein different configurations are formed by rotating the interactive panels at joints between the abutting interactive panels.

20. The collapsible music apparatus of claim 19, wherein the different configurations include a cube configuration, a rectangular prism configuration, a triangular prism configuration, a zig-zag configuration, and a display configuration.

* * * * *